US006226908B1

(12) United States Patent
Byers

(10) Patent No.: US 6,226,908 B1
(45) Date of Patent: May 8, 2001

(54) LETTER BOX MESSAGING SYSTEM

(75) Inventor: Thomas L. Byers, Mustang, OK (US)

(73) Assignee: Gary Products Group, Inc., Lubbock, TX (US)

( * ) Notice: Subject to any disclaimer, the term of this patent is extended or adjusted under 35 U.S.C. 154(b) by 0 days.

(21) Appl. No.: 09/248,671

(22) Filed: Feb. 11, 1999

(51) Int. Cl.[7] ..... G09F 13/04
(52) U.S. Cl. ..... 40/575; 40/716
(58) Field of Search ..... 40/575, 564, 716; 362/806

(56) References Cited

U.S. PATENT DOCUMENTS 2,623,314 * 12/1952 Lombard ..... 40/716
2,902,787 * 9/1959 Cook ..... 40/716
5,359,506 * 10/1994 Koleno ..... 362/248
5,454,181 * 10/1995 Rothman et al. ..... 40/564
5,761,838 * 6/1998 Chisholm et al. ..... 40/716
5,813,747 * 9/1998 Kale ..... 362/123
5,911,501 * 6/1999 Katz ..... 362/267

* cited by examiner

*Primary Examiner*—Joanne Silbermann
(74) *Attorney, Agent, or Firm*—Locke Liddell & Sapp LLP

(57) ABSTRACT

A system or kit for creating readily changeable messages is provided. The system includes a plurality of letter boxes, a plurality of removably mountable and interchangeable letter panels and a plurality of lights. Each letter box has an opening for receiving a light such that when the panel is attached thereto, the panel is backlit so that an image imprinted on the panel will be visually perceptible. The letter boxes can be arranged in any order to create any desired design or message. The message can be easily changed simply by moving the panel and replacing it with another panel having a different image thereon and/or adding or removing other letter boxes. The letter boxes are nestable within one another such that a kit including a plurality of letter boxes, lights and letter panels can be placed in a single package for shipping, sale and/or storage purposes.

15 Claims, 11 Drawing Sheets

LETTER BOX MESSAGING SYSTEM

BACKGROUND OF THE INVENTION

This invention relates generally to a system for creating visually perceptible messages that can be easily and readily changed. More particularly, the present invention relates to a system that includes a plurality of illuminable letter boxes and a plurality of image panels that have desired images or indicia defined thereon. The image panels can be removably and interchangeably mounted to the letter boxes and arranged in any desired order to create any desired design or message.

At various times throughout the year, homeowners, businesses, and other individuals desire to display messages to the public. Such homeowners and businesses desire to display decorative and/or inspirational messages on their homes and/or facilities, particularly during holiday seasons, such as Thanksgiving, Christmas, New Year, Valentine's Day and other holidays. There are presently a number of ways in which such messages are displayed. For instance, a message can be displayed by use of a wire form which has been configured into a particular message. Such wire forms may have lights wrapped therearound so that the message can be displayed at night. Likewise, messages can be displayed with the use of neon signs and plastics molded into various shapes. While such products effectively display a message, they are limited. A wire form typically cannot be reshaped effectively into a different form or message. Likewise, while neon signs and molded or formed messages can be reused, different signs and/or messages must be purchased if a different message is desired. To Applicant's knowledge, there are no systems which provide for the creation of readily changeable decorative, informational and/or inspirational messages, so that different message and/or design configurations can be displayed. Thus, there is a need for a system where apparatus for creating and displaying decorative messages and which allows the message and/or design being displayed to be easily changed.

SUMMARY OF THE INVENTION

The present invention provides a system for creating desired or selected messages which can be mounted to virtually any desired mounting site.

The system includes a plurality of illuminable letter or image boxes, a plurality of letter or image panels and a plurality of lights. The letter panels are removably mountable to the letter boxes, and are interchangeable, so that letter panels having selected images can be removably mounted to the letter boxes and the letter boxes arranged in any desired order or configuration to create a desired design or message such as MERRY CHRISTMAS, NOEL or any other desired message.

The image defined on each letter panel may comprise a letter, a combination of letters, a symbol or any design. The letter boxes are adapted to be mounted to a variety of structures including a rooftop, ceiling, vertical surfaces such as a wall, or can be simply mounted to a ground surface.

Each letter box comprises a rear panel and a wall extending outwardly therefrom to define a forward opening. The outwardly extending wall preferably comprises upper, lower, left and right side walls which define the forward opening. The letter panels are adapted to be removably mounted to each letter box to cover the forward opening. The light source, preferably a light received in each letter box, illuminates the letter box and the letter panel. The images imprinted on the letter panels are darker than the surrounding area thereon which is preferably translucent. The image is preferably opaque. Thus, the image defined on each letter panel will be easily visually perceptible when the letter panel is illuminated by the light. Each letter box includes a retainer lip for holding the letter panels to the letter boxes.

The letter boxes are nestable in one another so that the letter boxes can be nested for shipping, storage or other purposes. Thus, a system or kit including a plurality of letter boxes nested together, a plurality of lights and a plurality of letter panels may all be placed in a single package. The lights utilized with the messaging system are preferably typical Christmas lights connected by interconnecting wires and adapted to be connected to a power source.

The present invention thus provides a kit or system which can include any number of illuminable letter boxes, letter panels and lights so that any desired message and/or design can be presented and mounted to virtually any desired mounting site.

BRIEF DESCRIPTION OF THE DRAWINGS

FIG. 3 is a front elevation view of a letter box of the present invention.

FIG. 6 is a bottom view of a letter box of the present invention.

FIG. 9 is a section view taken from line 9—9 of FIG. 4.

FIG. 12 shows a letter box mounted to a roof.

FIG. 16 shows a letter box mounted to a ground surface.

DETAILED DESCRIPTION OF THE PREFERRED EMBODIMENTS

Figure 1:
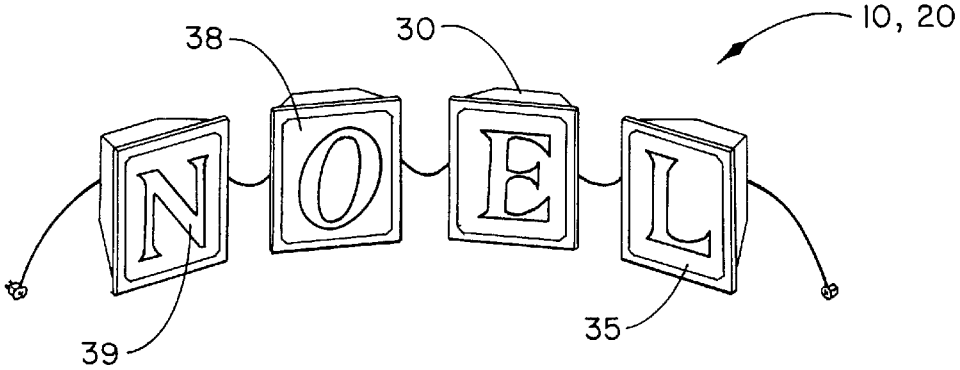
FIG. 1 is a schematic of a plurality of letter boxes of the messaging system of the present invention arranged to display a message.
Figure 2:
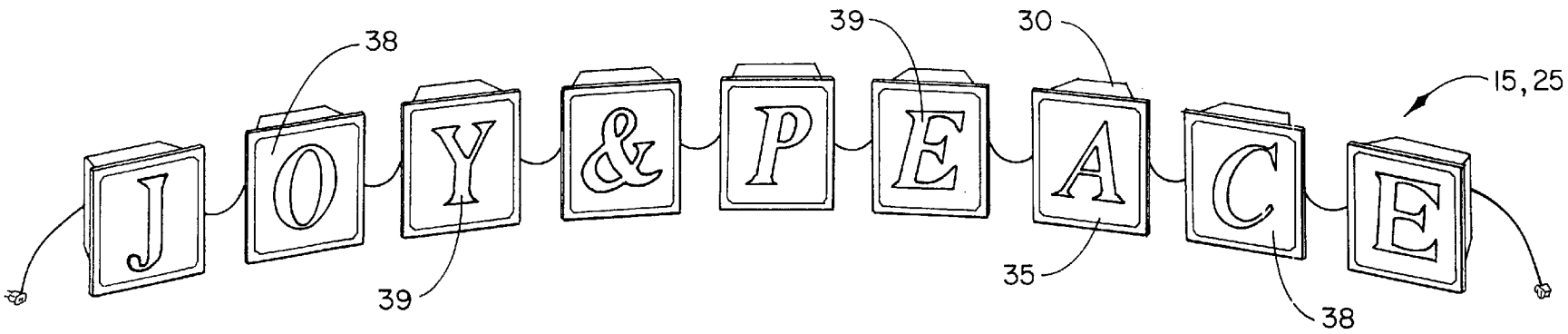
FIG. 2 is a schematic of letter boxes of the system of the present invention configured to display a message.
Figure 2:
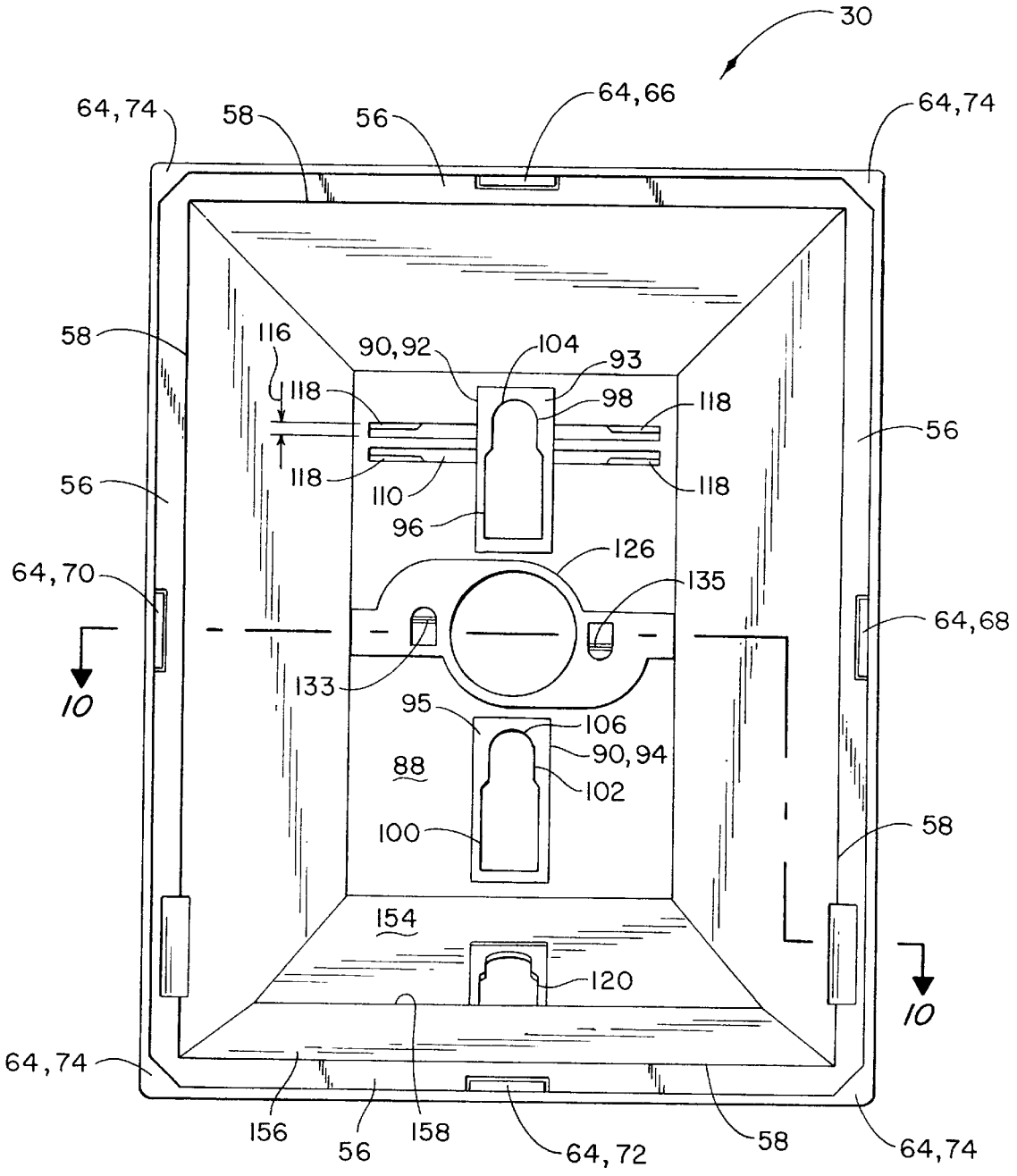

Referring now to the figures, decorative messages 10 and created by the system or kit for creating messages of the present invention are shown in FIGS. 1 and 2. The system or kit for creating messages comprises a plurality of image or letter boxes 30, image or letter panels 35 and a plurality of lights 40. The systems shown in FIGS. 1 and 2 are designated as systems or kits 20 and 25, respectively. However, it is understood that the system or kit of the present invention is not restricted or limited in any way to any particular number of letter boxes, panels and lights.

Figure 4:
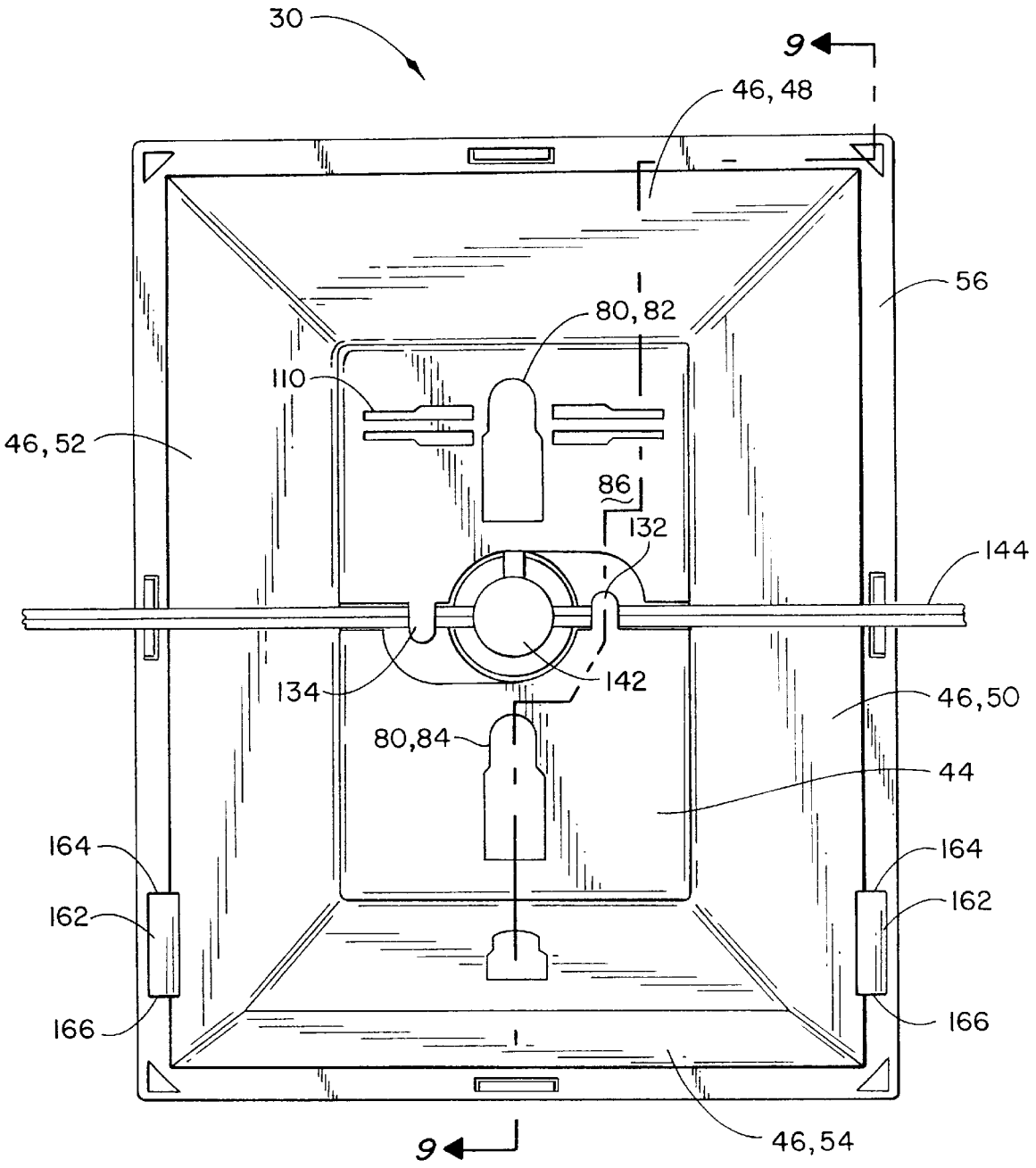
FIG. 4 is a rear elevation view of a letter box of the present invention showing a light connected thereto.
Figure 5:
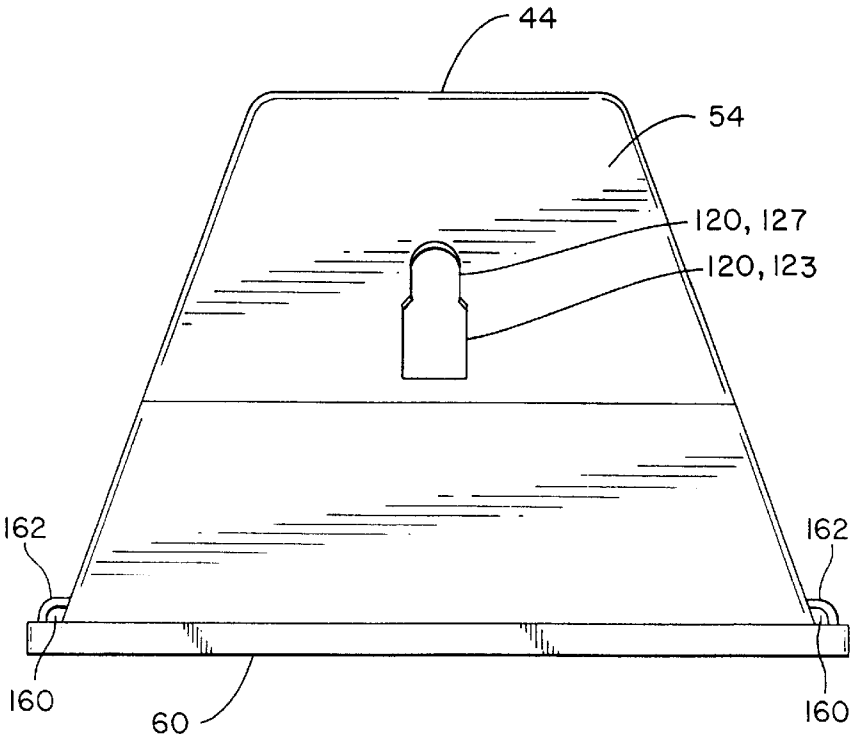
FIG. 5 is a side elevation view of a letter box of the present invention.
Figure 5:
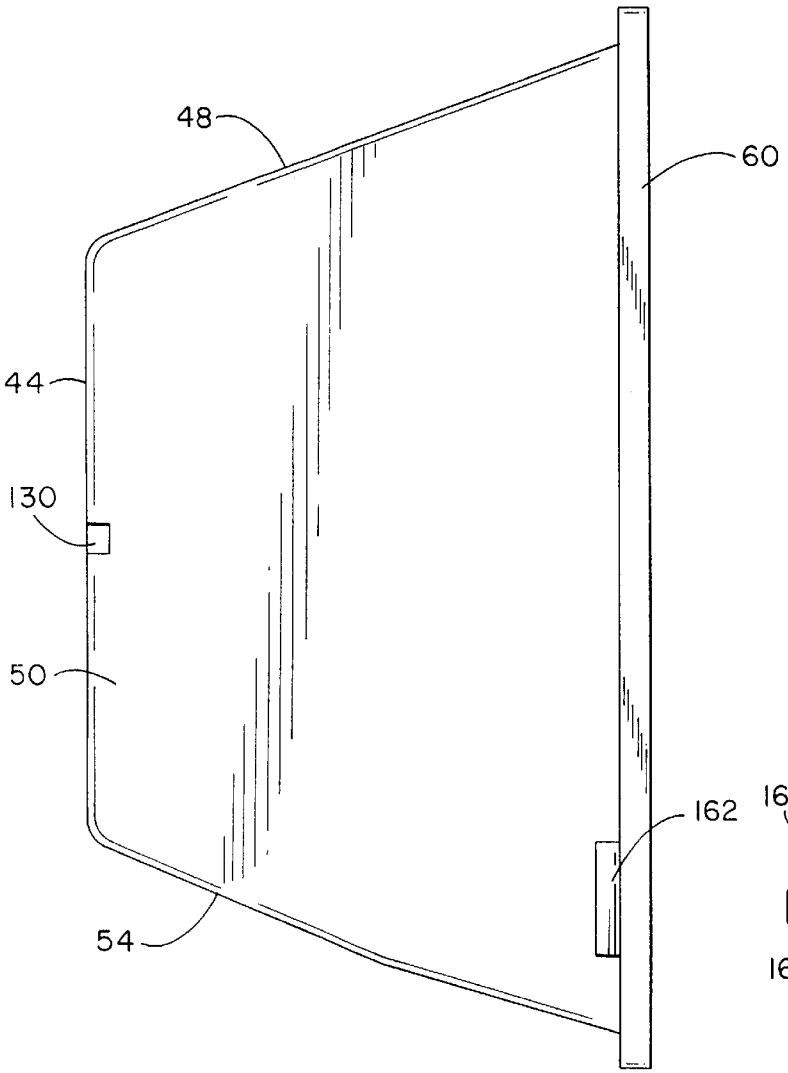
Figure 7:
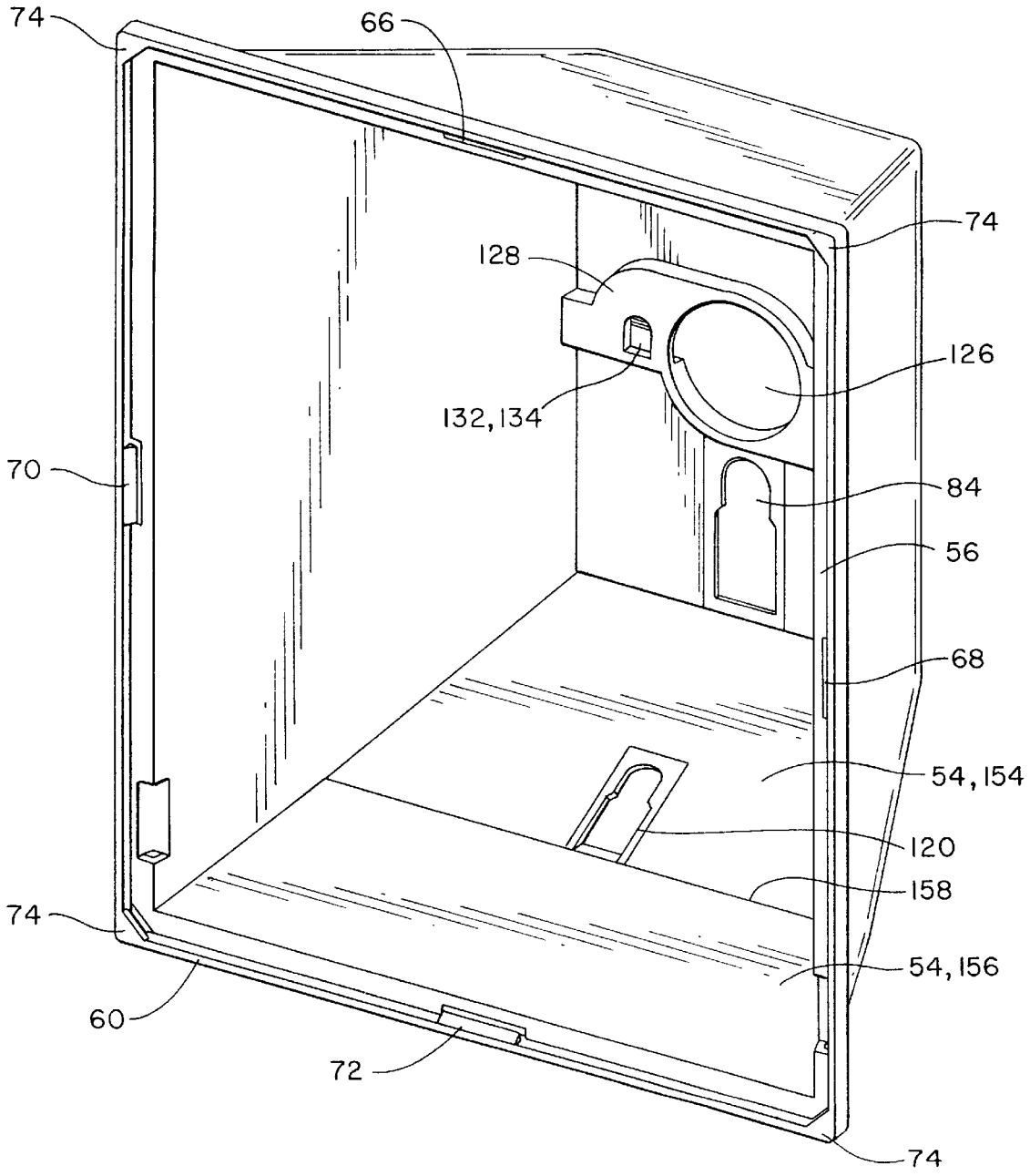
FIG. 7 is a perspective view showing the front, one side and the top of a letter box of the present invention.
Figure 8:
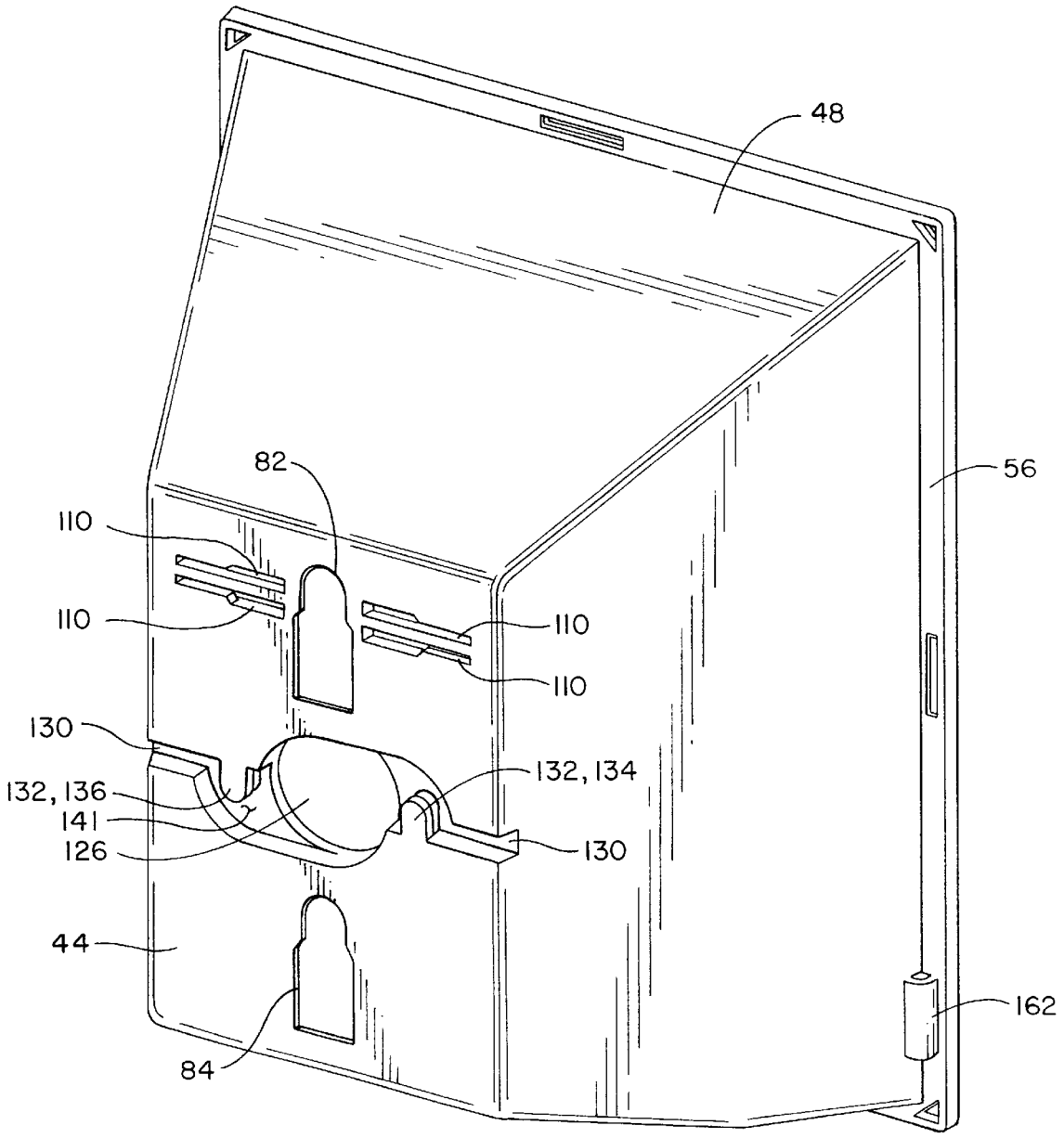
FIG. 8 is a perspective view showing the rear panel, one side and the top of a letter box of the present invention.
Figure 10:
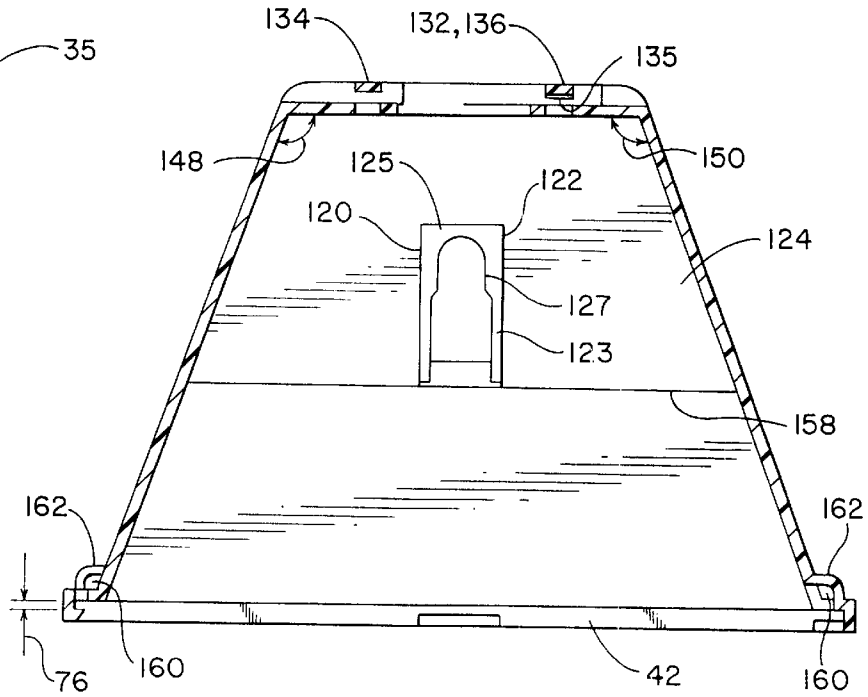
FIG. 10 is a section view taken from line 10—10 of FIG. 3.

As shown in FIGS. 3–10, each image box 30 defines a forward opening 42, and comprises rear panel 44 and an outer wall 46 extending forward therefrom to define forward opening 42. Lights 40 are shown in FIGS. 4 and 9, but not in the remaining figures for the sake of clarity. Outer wall 46 may comprise an upper wall 48, left and right side walls 50 and 52, and bottom wall 54, which define forward opening 42.

Letter box 30 has a flange 56 extending outwardly from the forward edge 58 of outer wall 46 around the periphery thereof. A panel border 60 extends forward from the outer edge 62 of flange 56. A letter, or image panel mounting means 64 for removably mounting letter panels 35 is also included.

Panel mounting means 64 may comprise a plurality of retaining lips connected to border flange 60. Letter box 30 may thus include an upper retaining lip 66, a right-side retaining lip 68, a left-side retaining lip 70, a lower retaining lip 72 and corner retaining lips 74. Retaining lips 66, 68, 70, 72 and 74 are connected to panel border 60. A space 76 is defined between flange 56 and lips 66, 68, 70, 72 and 74. The edges of panel 35 may be placed between retaining lips 66, 68, 70, 72 and 74 and flange 56 so that the retaining lips hold image panel 35 to letter box 30 such that image panel 35 covers forward opening 42. If desired, image or letter panel 35 may be made of a flexible material so that it can be snapped into place between the retaining lips and flange 56. The image panel may be easily removed from a letter box simply by moving the panel from between the flange 56 and the retaining lips, and may be mounted to a separate letter box if desired. Thus, the image panels are removably and interchangeably mountable to the letter boxes.

Image panels 35 are preferably generally rectangularly shaped panels having a front, or forward side 36 and rear side 37. Each image panel has an image or indicia defined thereon, such as a letter, symbol, or any desired design. The images on the panels shown in FIGS. 1 and 2 comprise letters, so that the letter boxes can be arranged in the desired order to spell out selected messages, such as NOEL or PEACE & JOY. The image may be any desired letter, symbol, number or other desired design or figure.

The letter panels are preferably translucent, or transparent, and the image defined thereon is preferably a darker color than the remainder of the panel, and is preferably opaque. Thus, panels 35 have a translucent portion 38, and a dark or opaque image portion 39. The panels are such that when letter boxes 30 are illuminated as described herein, the images on each panel are visually discernable so that the message or design is easily seen.

Figure 13:
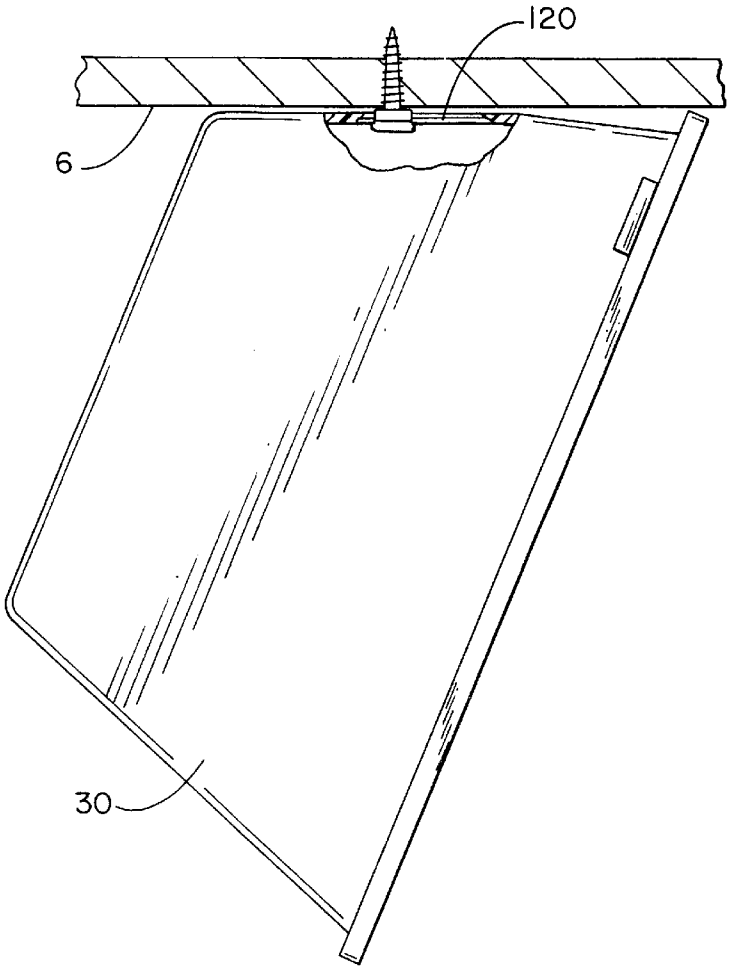
FIG. 13 shows a letter box mounted to a horizontal surface, such as a soffit or a ceiling.
Figure 14:
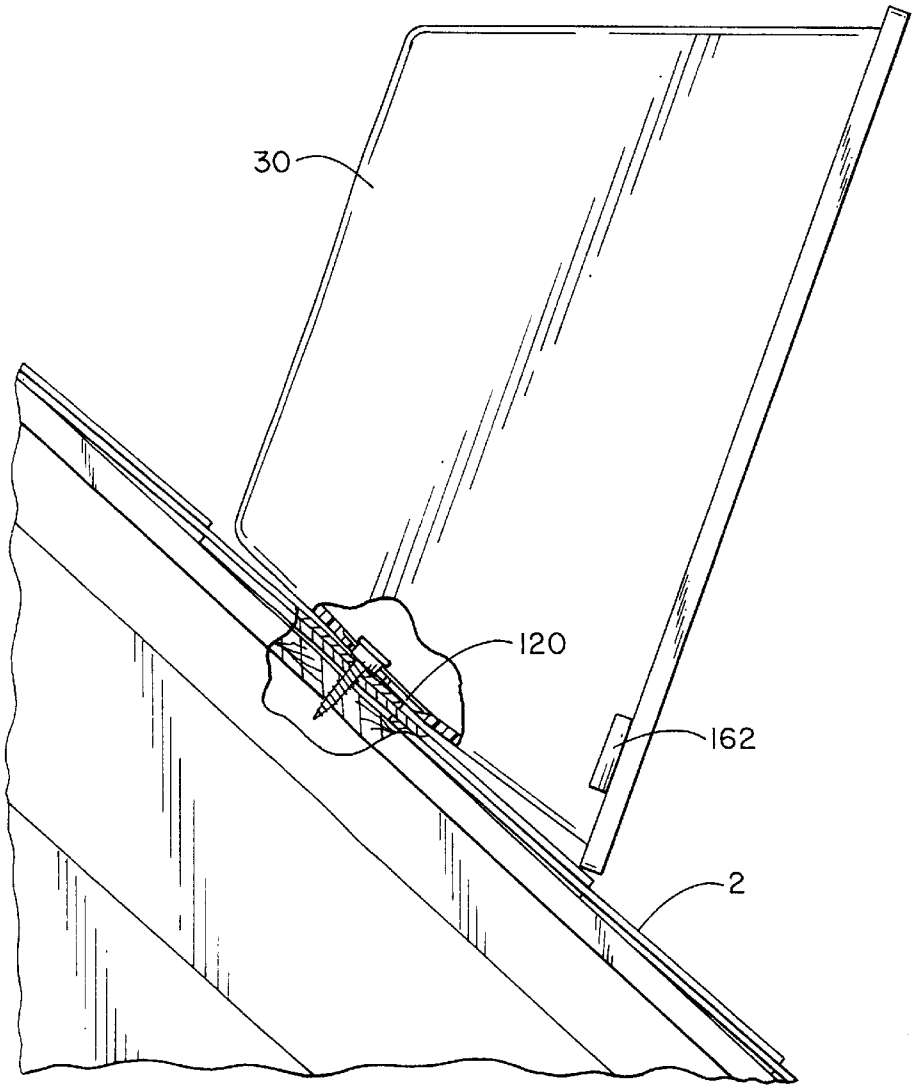
FIG. 14 shows a letter box mounted to a vertical surface, such as a wall or vertical stake.
Figure 15:
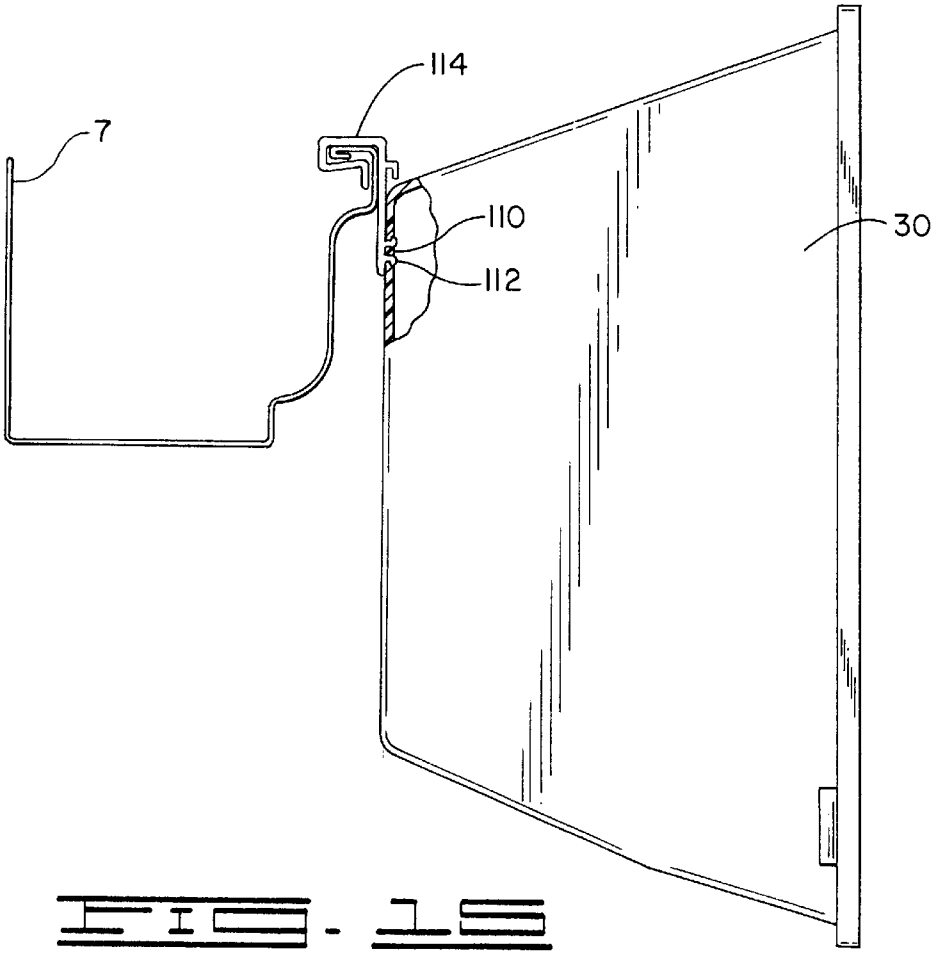
FIG. 15 shows a letter box mounted to a gutter.
Figure 14:
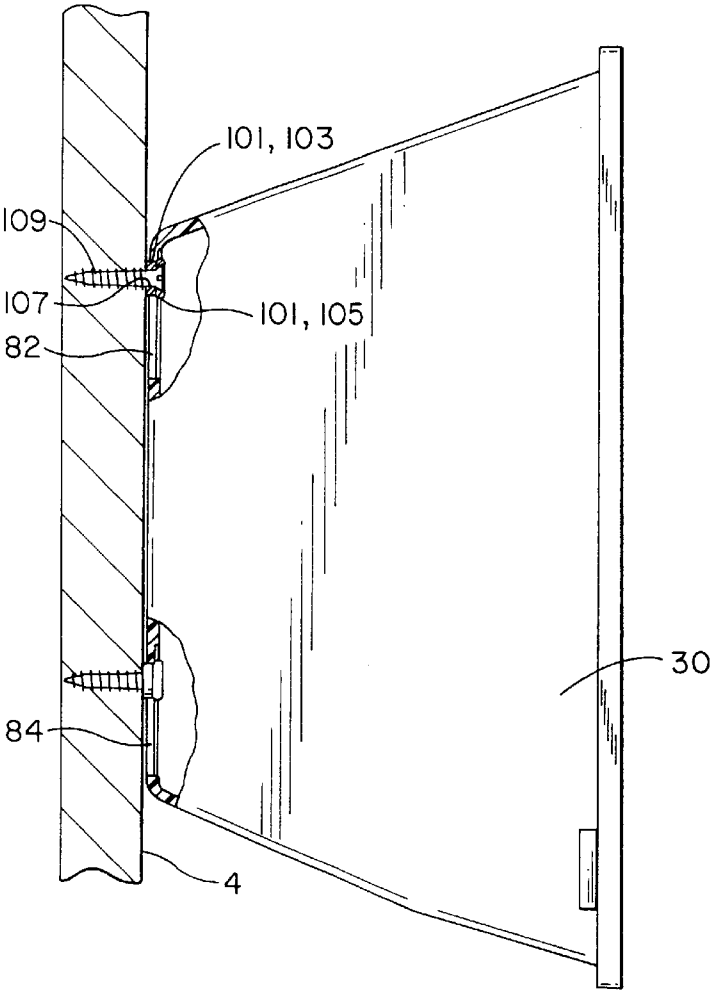
Figure 18:
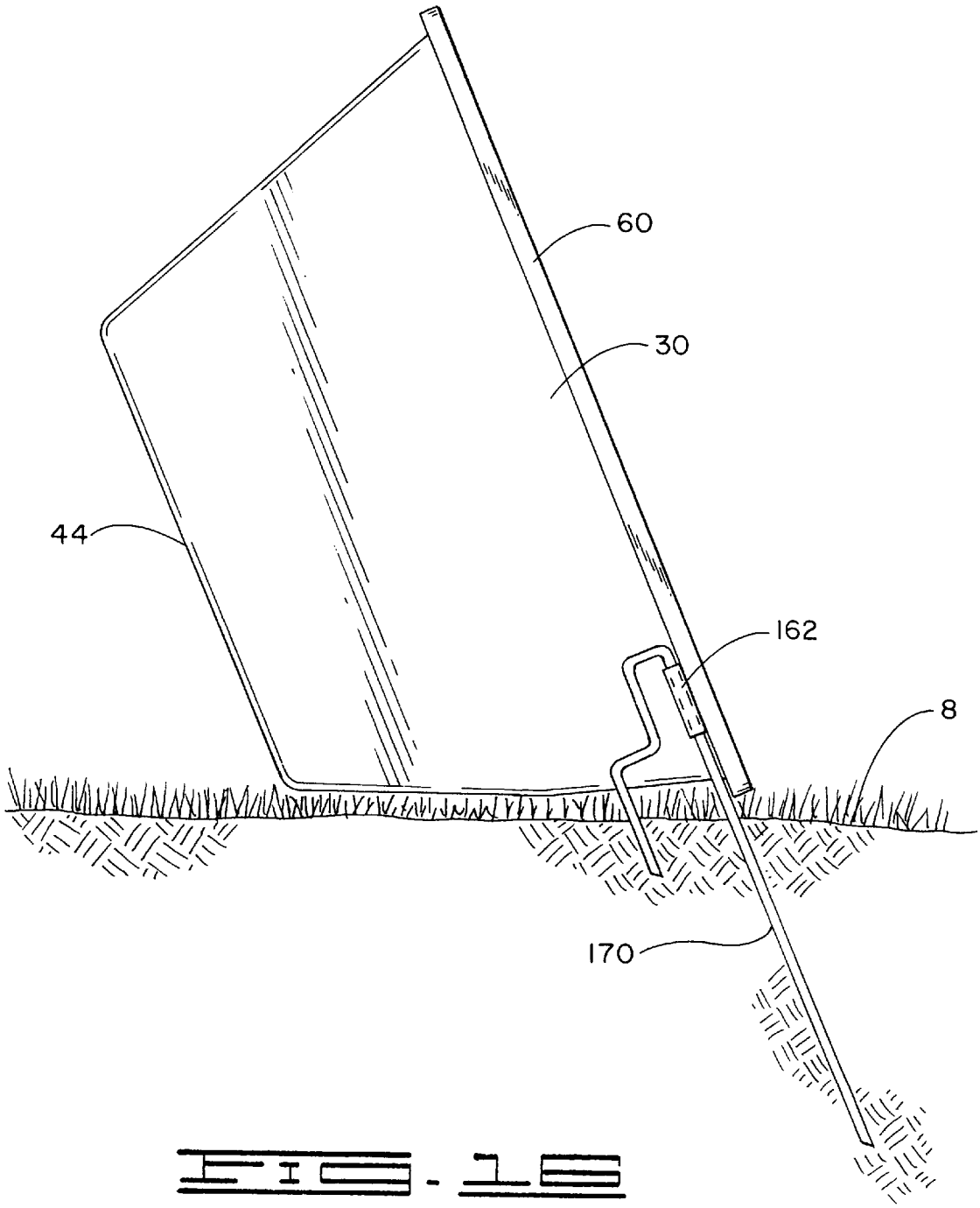

Each letter box 30 includes a mounting means for mounting the letter box to a desired mounting site. Letter boxes 30 may be mounted to any desired mounting site such as a rooftop 2, as shown in FIG. 12, a horizontal surface 6 such as a soffit or ceiling as shown in FIG. 13, vertical surface 4 such as shown in FIG. 14 which may be a facia or wall board of a structure, a gutter 7, with the use of gutter clips, as shown in FIG. 15 and a ground surface 8 as shown in FIG. 16. Thus, the letter boxes can be mounted to virtually any surfaces, regardless of the angular orientation or the configuration of the surface.

The mounting means may include a pair of slots or keyways 80 defined in rear panel 44. Slots 80 may be referred to as first, or upper and second, or lower slots 82 and 84. Rear panel 44 has outer surface 86 and inner surface 88 and has recessed portions 90 which may comprise upper and lower recessed portions 92 and 94, respectively. Upper and lower slots 82 and 84 are defined in rear panel 44 at upper and lower recessed portions 92 and 94, respectively. As shown in FIG. 9, recessed portions 92 and 94 have inner surfaces 93 and 95, respectively, recessed from surface 88.

Upper slot 82 has a wide portion 96 and a narrow portion 98. Likewise, lower slot 84 has a wide portion 100 and a narrow portion 102. As shown in FIG. 14, letter box 30 can be mounted to a desired mounting site with the use of fasteners by locating the mounting box such that the heads of the fasteners are positioned in the wide portion of the upper and lower slots 82 and 84, respectively, and sliding the box down so that upper ends 104 and 106 of slots 82 and 84 engage the fasteners. The fastener head will be located in the narrow portion of slots 82 and 84 and will have a head diameter that extends beyond the edges of the narrow portion of slots 82 and 84 to engage the recessed portions of the rear panel and hold the letter box in place.

If desired, a snap button like that shown in FIG. 14 can be utilized in combination with a fastener to attach or mount the letter box to a surface utilizing slots 82 and 84. Snap button 101 has a base or neck 103, and a head 105 having a diameter larger than the diameter of the base. Snap button 101 has an opening 107 for receiving a fastener 109 to mount the snap button to a mounting site.

Snap buttons 103 may be received in wide portions 96 and 100 of slots 82 and 84, respectively, and box 38 will slide down until the snap buttons engage the upper end of slots 82 and 84. The snap buttons will be located in narrow portions 98 and 102 of slots 82 and 84, and will hold letter box 30 in place.

A plurality of gutter clip slots 110 are also defined in rear panel 44. Slots 110 are adapted to receive tangs 112 defined on a gutter clip 114 to mount letter box 30 thereto. Gutter clip 114 is shown in FIG. 15 and is adapted to be attached to a gutter 7. Gutter clip slots 110 have a width 116 and each slot has a mounting lip 118 extending therein. Width 116 is such that tangs 112 can be inserted therethrough and then moved along the slots so that tangs 112 will engage lips 118 thus mounting letter box 30 to gutter clip 114 and gutter 7.

A third mounting slot 120 is defined through bottom wall 54. A recessed portion 122 is defined in the inner surface 124 of bottom wall 54 and has a recessed surface 125. Preferably, third mounting slot 120 is defined in recessed portion 122. Third mounting slot 120 has a wide portion 123 and a narrow portion 127. Third mounting slot 120 is thus adapted to receive a fastener head or snap button as previously described. Thus, the letter box can be mounted with third mounting slot 120 to an angled surface such as a rooftop as shown in FIG. 12 or a horizontal surface such as a soffit or ceiling as shown in FIG. 13 or to any other desired structure having virtually any orientation.

As is clear from the figures, rear panel 44 is preferably generally rectangular in shape as is forward opening 42. Forward opening 42 is larger than rear panel 44. Upper, left, right and bottom walls 48, 50, 52 and 54, respectively, extend outwardly from rear panel 44 at angles 146, 148, 150 and 152, respectively. Lower wall 54 preferably comprises inner and outer portions 154 and 156 having a break line 158 therebetween. An angle 159 is defined by portions 154 and 156 at break line 158. Preferably, angle 159 is slightly less than 180°, so that letter box 30 is adapted to be mounted to a surface oriented at virtually any angle as depicted in FIGS. 12 and 13.

Letter boxes 30 are also adapted to be mounted directly to a ground surface. Letter boxes 30 thus include mounting slots 160 defined at or near the forward edge of left and right side walls 50 and 52. Slots 160 are defined by mounting bosses 162 having upper and lower ends 164 and 166, respectively. Mounting bosses 162 are attached to an outer surface of the left- and right-hand side walls and to flange 56. As shown in FIG. 16, a yard stake 170 can be received through slots 160 to mount letter boxes 30 to a ground surface, so that a yard display can be created. Thus, as shown by FIGS. 12–16, the letter boxes can be mounted to a number of structures such as a ceiling, soffit, gutter, yard, any vertical surface such as a wall, a rooftop and virtually any other type of surface.

Letter boxes 30 are illuminable, and thus include means for attaching lights thereto. A light receiving hole or light receptacle 126 is defined through rear panel 44. Rear panel 44 also includes an inwardly recessed portion 128 that circumscribes light receptacle 126. Recessed portion 128 defines a slot 130 in rear panel 44 for receiving the connecting wires in a light string. A pair of wire retaining clips 132, which may comprise a first or upward pointing clip 134 and a second or downward pointing retaining clip 136 are defined on rear panel 44. Retaining clips 134 and 136 are spaced from an outer surface 141 of recessed portion 128.

Referring now to FIG. 9, lights 40 are received in light receptacle 126. Lights 40 may be referred to as a means for illuminating or for a light source for providing light to letter boxes 30. Lights 40 preferably comprise a light string 140 that includes lights 40 and light sockets 142 connected by interconnecting wires 144. Light string 140 preferably utilizes standard-size Christmas lights, but can be any type of light and light socket arrangement. Light string 140 is adapted to be connected to a power source and preferably is adapted to be attached or connected to other strings of light as is well known in the art. Interconnecting wires 144 as shown in FIG. 4 are placed between retaining clips 132 and recessed portion 128 of rear panel 44 and are received in slots 130. Retaining clips 134 and 136 have protrusions 133 and 135 to hold wires 144 in place. Lights 40 illuminate letter boxes 30, and illuminate panels 35. Panels 35 may thus be referred to as backlit letter panels. Because panels 35 are translucent, and the images defined thereon are darker than the remainder of the panel, or are substantially opaque, the images can be easily seen when lights 40 are lit to illuminate the panel.

Thus, the present invention provides a messaging system that may include any desired number of letter boxes that can be arranged in any desired configuration. FIGS. 1 and 2 show arcuate configurations of letter boxes arranged to display messages. Letter boxes 30 can be placed in any desired configuration and image panels 35 can be removably attached thereto as described above. Letter panels 35 are interchangeable and can be placed on any letter box 30 such that any desired message and/or design can be created simply by removing and replacing one letter panel with another letter panel, and rearranging the letter boxes, adding more letter boxes, or removing letter boxes. In this way, messages such as NOEL, PEACE & JOY, MERRY CHRISTMAS or any other message can be created. Likewise, if desired, image panels with design configurations thereon such as Christmas trees, snowmen or other figures, can be removably mounted to a letter box and displayed. The present invention thus provides a system for creating messages and designs that can be readily and easily changed to another desired message.

Figure 11:
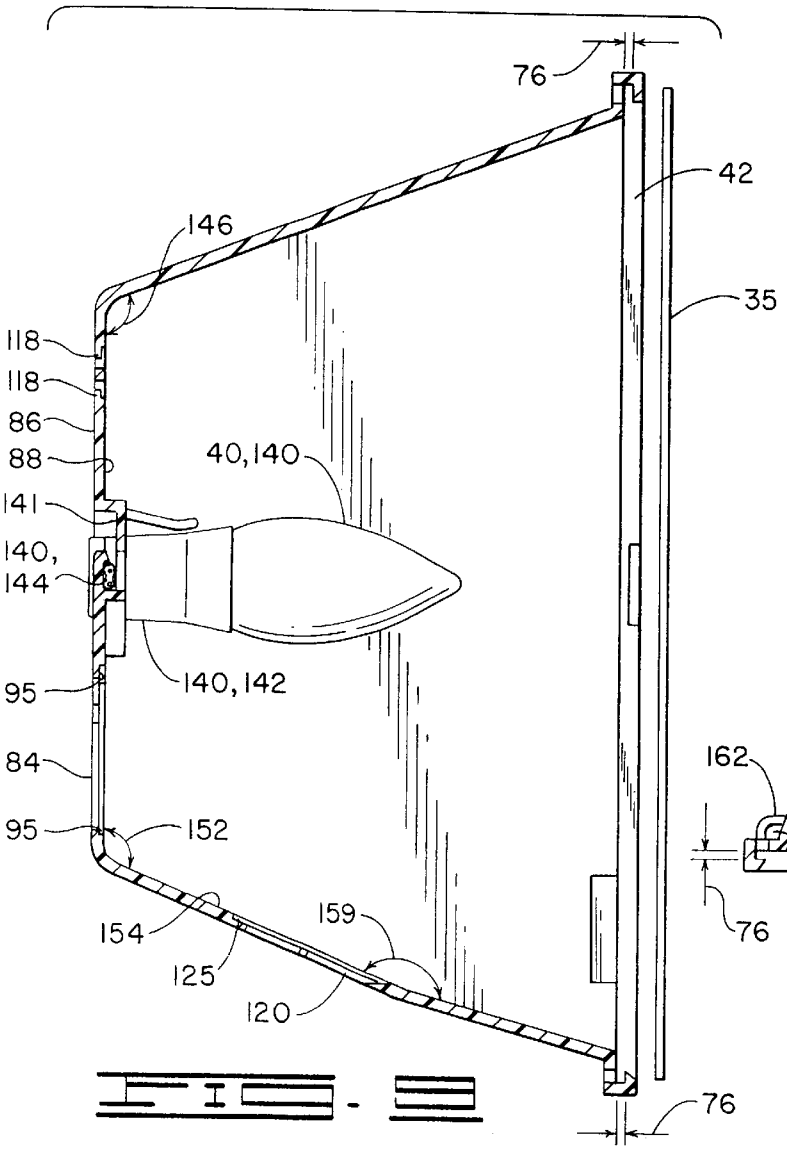
FIG. 11 shows a section view of a kit which includes a plurality of letter boxes in a section view, nested together and located in a packaging unit along with a plurality of letter panels and a light string.
Figure 11:
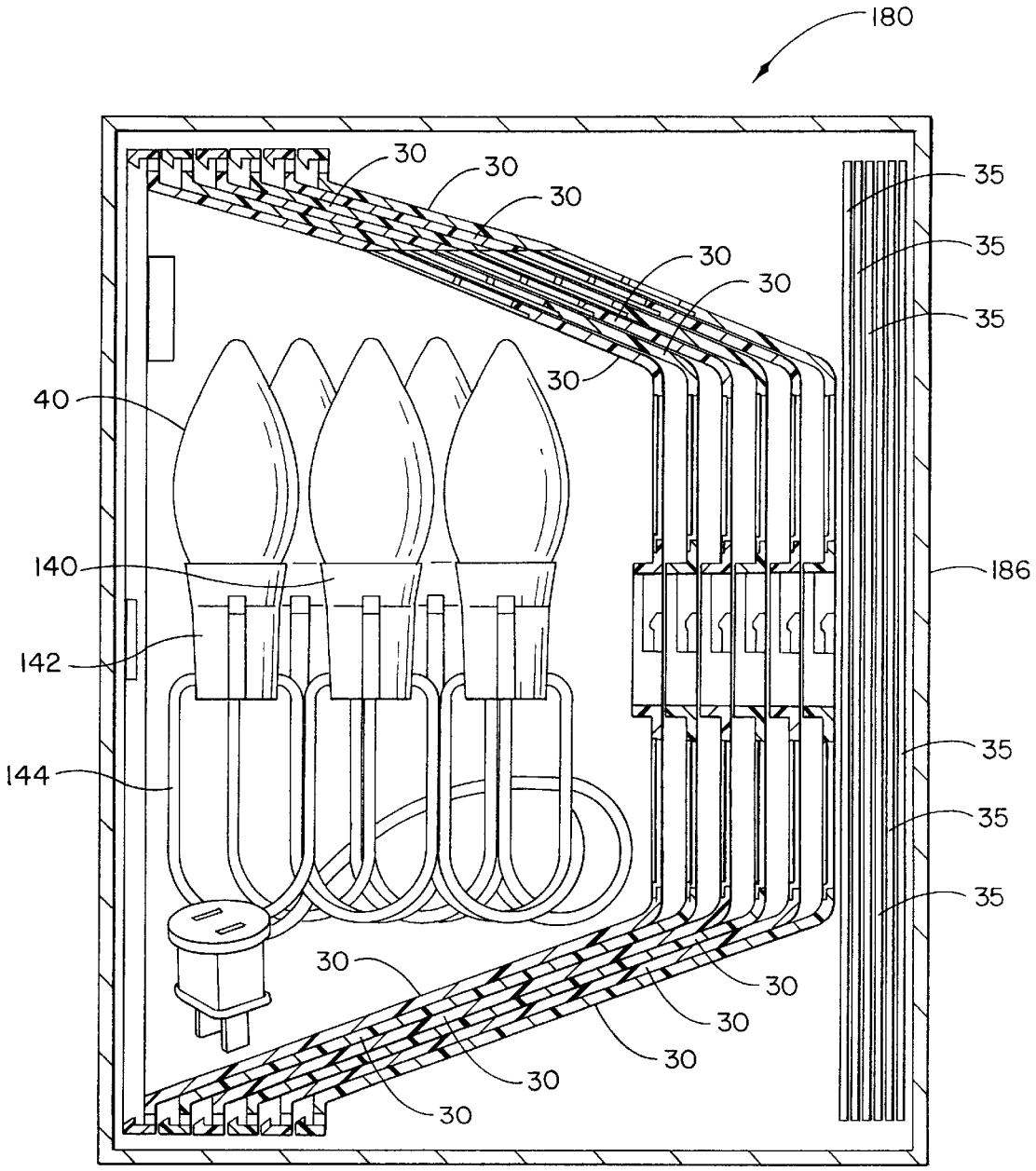

Because of the shape of the letter boxes, the letter boxes are nestable. Thus, letter panels 35 can be removed from letter boxes 30 so that letter boxes 30 may be nested together and the lights, letter boxes and panels can be packaged in one package for sale, shipping and storage purposes. A kit, or system 180 that includes a plurality of letter boxes 30, light string 140 including a plurality of lights 40 and a plurality of letter panels 35, all disposed and easily contained in a package 186 is shown in FIG. 11. System 180 includes six letter boxes, a light string including six lights and six letter panels. However, as set forth herein, the system or kit of the present invention is not limited by any particular number. Thus, a kit can include any number of panels, boxes and lights and kits can be utilized together so that messages of virtually any length, and including any number of panels, can be displayed.

Thus, it is seen that the apparatus and methods of the present invention readily achieve the ends and advantages mentioned as well as those inherent therein. While certain preferred embodiments of the present invention have been illustrated for the purposes of this disclosure, numerous changes in the arrangement and construction of parts may be made by those skilled in the art which changes are encompassed within the scope and spirit of the invention as defined by the appended claims.

What is claimed is:

1. A system for creating messages comprising:

a plurality of image boxes, each box defining a forward opening;

a plurality of image panels having images, each of said plurality of image panels having images imprinted thereon, said panels being mountable to said boxes to cover said forward opening, wherein said boxes are adapted to be positioned in any desired configuration, said image panels being removably mountable and interchangeable, such that said panels may be removably mounted to any of said plurality of boxes to place said images in a desired order, thereby creating a desired design or message; and each of said boxes includes a mounting aperture for receiving a stake, wherein said stake is received by and passes through said mounting aperture and into a ground surface for holding each of said boxes in place on the ground surface.

2. The system of claim 1 wherein each of said images comprises one of at least one letter or symbol having a known meaning, so that said image panels may be removably mounted to said boxes in a desired order to create a desired message.

3. The system of claim 1 and further comprising a plurality of light sources for providing light to an interior of each of said boxes to illuminate said image panels.

4. The system of claim 3, wherein each of said plurality of image panels is at least light transmissive and, wherein said images defined thereon are substantially opaque so that said images are easily perceptible when said light sources illuminate said image panels.

5. The system of claim 3 wherein said light sources are connected by connecting wires, each of said boxes having an opening for receiving one of said light sources.

6. The system of claim 1 wherein said boxes are nestable in one another when said panels are removed therefrom.

7. The system of claim 1 wherein each of said boxes comprises:

a rear panel;

four walls extending outwardly from said rear panel to define said forward opening; and a retaining lip for removably mounting said image panel to said box.

8. A kit for arranging images in a desired configuration comprising:

a plurality of letter boxes, each of said letter boxes defining a forward opening, wherein said letter boxes are nestable in one another;

a plurality of letter panels, each of said panels having an image defined thereon, wherein said letter boxes may be positioned in a desired configuration and said letter panels are removably and interchangeably mounted thereto, so that said letter panels can be readily and selectively placed in any desired order to create a desired design or message; and each of said boxes includes a mounting aperture for receiving a stake, wherein said stake is received by and passes through said mounting aperture and into a ground surface for holding each of said boxes in place on the ground surface.

9. The kit of claim 8 and further comprising a plurality of light sources for providing light to each of said letter boxes.

10. The kit of claim 9 and further comprising a packaging unit having a plurality of said letter boxes, a plurality of said letter panels and said plurality of light sources contained therein.

11. The kit of claim 9, wherein said plurality of light sources comprise a light string, said light string comprising a plurality of bulb sockets having said lights received therein and connecting wires connection said bulb sockets.

12. The kit of claim 8 wherein each of said letter boxes comprises:

a rear panel; and four walls extending forward from said rear panel to define said forward opening.

13. The kit of claim 12, wherein said walls of each of said boxes include a flange defined thereon at a forward edge thereof, and having at least one retaining lip extending from said flange for holding said letter panel in place, wherein an edge of said letter panel is received between said retaining lip and said flange.

14. The kit of claim 8 wherein each of said boxes further includes a retaining lip for removably mounting said letter panel adjacent said forward opening.

15. An illuminable letter box adapted to be removably mounted to a ground surface comprising:

a rear panel;

four walls extending from said rear panel and defining a forward opening, said rear panel defining a light receptacle;

a letter panel having an image thereon, said letter panel being removably mounted to said letter box to cover said forward opening;

a light received in said light receptacle for illuminating said letter panel ;and one of said walls including a mounting aperture for receiving a stake, wherein said stake is received by and passes through said mounting aperture and into the ground surface for holding the box on the ground surface.

* * * * *